US008141635B2

(12) United States Patent
Chang et al.

(10) Patent No.: US 8,141,635 B2
(45) Date of Patent: Mar. 27, 2012

(54) CASED BOREHOLE TOOL ORIENTATION MEASUREMENT

(75) Inventors: Chung Chang, Lexington, MA (US); Henri-Pierre Valero, Belmont, MA (US); Jean G. Saint Germain, Cambridge, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 715 days.

(21) Appl. No.: 12/248,176

(22) Filed: Oct. 9, 2008

(65) Prior Publication Data

US 2010/0089572 A1 Apr. 15, 2010

(51) Int. Cl.
*E21B 47/00* (2006.01)
*E21B 47/022* (2006.01)

(52) U.S. Cl. ..... 166/255.2; 33/302; 33/366.12; 73/178 R; 166/254.1; 702/9; 702/6

(58) Field of Classification Search ..... 33/302, 33/304, 313, 379, 384, 389; 166/255.2
See application file for complete search history.

(56) References Cited

U.S. PATENT DOCUMENTS

| | | | | |
|---|---|---|---|---|
| 3,771,118 | A | 11/1973 | Lichte, Jr. et al. | |
| 3,791,042 | A | 2/1974 | Bell | |
| 4,433,491 | A * | 2/1984 | Ott et al. | 33/302 |
| 4,461,088 | A | 7/1984 | Van Steenwyk | |
| 4,587,741 | A * | 5/1986 | Rorden et al. | 33/366.12 |
| 4,672,753 | A | 6/1987 | Kent et al. | |
| 5,155,916 | A * | 10/1992 | Engebretson | 33/302 |
| 5,435,069 | A | 7/1995 | Nicholson | |
| 5,606,124 | A | 2/1997 | Doyle et al. | |
| 5,644,078 | A * | 7/1997 | Ahdoot | 73/178 R |
| 6,631,563 | B2 | 10/2003 | Brosnahan et al. | |
| 2003/0236627 | A1 * | 12/2003 | Estes | 702/9 |
| 2004/0079526 | A1 * | 4/2004 | Cairns et al. | 166/255.2 |
| 2005/0154532 | A1 * | 7/2005 | Close et al. | 702/6 |
| 2009/0166035 | A1 * | 7/2009 | Almaguer | 166/254.1 |

OTHER PUBLICATIONS

Canny, John, "A computational approach to edge detection" IEEE Transactions on Pattern Analysis and Machine Intelligence, vol. PAMI-8, No. 6, Nov. 1986, pp. 679-698.
Henstock et al, "Automatic gradient threshold determination for edge detection" IEEE Transactions on Image Processing, vol. 5, No. 5, May 1996, pp. 784-787.
Qian et al, "Optimal edge detection in two-dimensional images", IEEE Transactions on Image Processing, vol. 5, No. 7, Jul. 1996, pp. 1215-1220.
Rosenfeld et al, "Edge and curve detection for visual scene analysis" IEEE Transactions on Computers, vol. c-20, No. 5, May 1971, pp. 562-569.
Tabb et al, "Multiscale image segmentation by integrated edge and region detection" IEEE Transactions on Image Processing, vol. 6, No. 5, May 1997, pp. 642-655.

* cited by examiner

*Primary Examiner* — Hezron E Williams
*Assistant Examiner* — Hoang Nguyen

(57) ABSTRACT

Methods and related systems are described for use for determining orientation of a measurement tool in a cased borehole. The measurement tool is deployed in a cased section of a borehole. The tool includes a volume containing a reference fluid having a first density, and a marker within the fluid having a different density. The position of the marker within volume containing the reference fluid is senses, and orientation information of the measurement tool is determined based at least in part on combining information relating to the position of the marker with prior recorded data representing orientation measurements made while the section of the borehole was not yet cased.

32 Claims, 7 Drawing Sheets

Fig. 1a
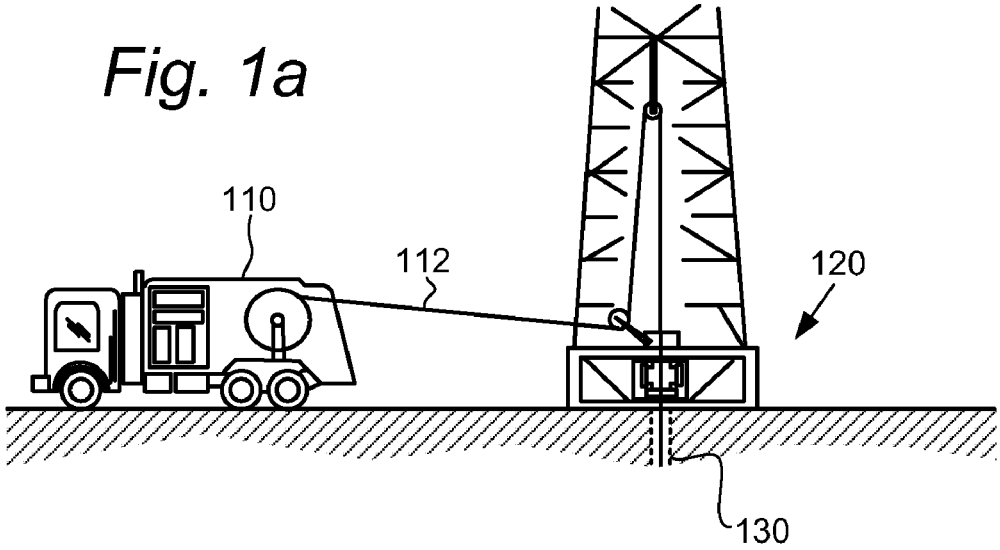
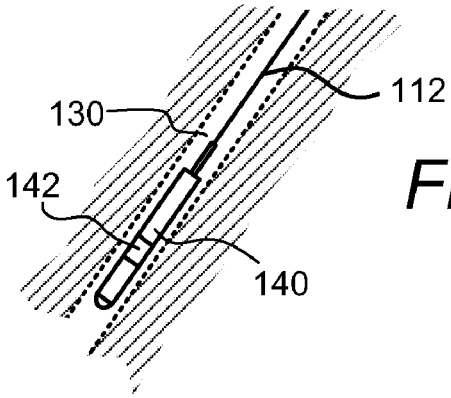
Fig. 1b
Fig. 1c
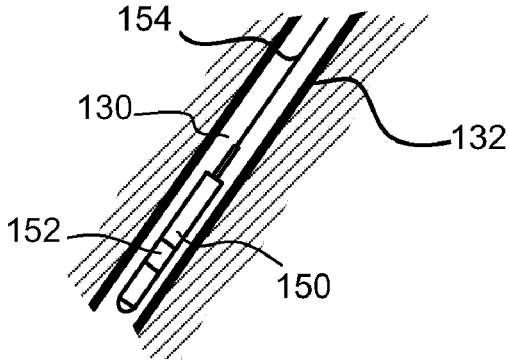

CASED BOREHOLE TOOL ORIENTATION MEASUREMENT

BACKGROUND OF THE INVENTION

1. Field of the Invention

This patent specification relates to measurements made in a borehole. More particularly, this patent specification relates to systems and methods for tool orientation measurements made in cased boreholes.

2. Background of the Invention

Traditionally, directional measurement devices used in tools designed to operate in open, uncased, boreholes have been based on a compass or other magnetometers and accelerometers. However, when operating inside a steel casing, such magnetic based measurements are not possible. Therefore, measuring the orientation of a borehole tool in a cased borehole environment has had difficulties. In addition, in some cases there are difficulties in open borehole measurements for oil wells close to north or south poles that have a downward magnetic directions causing the compass to function incorrectly. Current solutions include the use of optical gyros and mechanical gyros. Unlike other navigation applications for gyros, logging tools can experience many rapid turns while traveling along the borehole in addition to the surrounding environment which can be hostile in terms of pressures and temperatures, etc. The errors of such types of gyros start to accumulate during the descent and in-situ calibrations using independent measurement are necessary in order to ensure the quality and the accuracy of such measurements.

Some inclinometry tools such as Schlumberger's General Purpose Inclinometry Tool (GPIT) combines magnetometers and accelerometers to measure the orientations of a borehole tool while logging. For many years there are industrial wide research efforts to solve this difficult cased borehole problem without success. Commercial attempts have been made to provide gryo-based orientation and steering capabilities while drilling, as well as gyro-based wireline logging tools. For example, see Halliburton's Evader® Cryo-While Drilling Service; and Geo-Guide ALC™ from Gryodata Inc. However, unlike airplane application the borehole tool will experience many turns while traveling up and down the borehole and therefore, even a gyro will be subjected to large error accumulations and generally requires independent in-situ calibration which itself is technically challenging in addition to the surrounding hostile environment.

Prior attempts to solve the cased hole tool orientation problem have been aimed at duplicating the open borehole tool direction measurements while tool is inside a cased borehole. Generally speaking, there are three angular unknowns, azimuth, inclination and rotation that need to be measured in order to uniquely determine the borehole tool orientations. The azimuthal angle with respect to the north-south direction requires a reference such as the North Pole and this is particularly challenging to measure while inside a cased borehole without a gyro like device because the steel casing interferes with the external magnetic fields.

SUMMARY OF THE INVENTION

According to embodiments, a system for determining orientation of a measurement tool in a cased borehole is provided. The system includes a tool housing forming part of the measurement tool and being designed to be deployed in a cased section of a borehole. The system includes a volume within the tool housing and containing a reference fluid having a first density, and a marker having a second density, the marker being disposed within the volume containing reference fluid such that the marker is moveable within the volume, the second density being substantially different from the first density. A sensing system is adapted and positioned to sense the position of the marker within volume containing the reference fluid, and a processing system is adapted and programmed to determine orientation information of the measurement tool based at least in part on combining information relating to the position of the marker with prior recorded data representing orientation measurements made while the section of the borehole was not yet cased.

According to further embodiments a method for determining orientation of a measurement tool in a cased borehole is provided. The method includes deploying the measurement tool in a cased section of a borehole. The measurement tool includes a volume containing a reference fluid having a first density, and a marker having a second density, the marker being disposed within the volume containing reference fluid such that the marker is moveable within the volume, the second density being substantially different from the first density. The position of the marker within volume containing the reference fluid is sensed. Orientation information of the measurement tool is determined based at least in part on combining information relating to the position of the marker with prior recorded data representing orientation measurements made while the section of the borehole was not yet cased.

Further features and advantages of the invention will become more readily apparent from the following detailed description when taken in conjunction with the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIGS. 1*a*-1*c* show a wireline-based tool orientation measurement system, according to some embodiments;

DETAILED DESCRIPTION OF THE PREFERRED EMBODIMENTS

Figure 2:
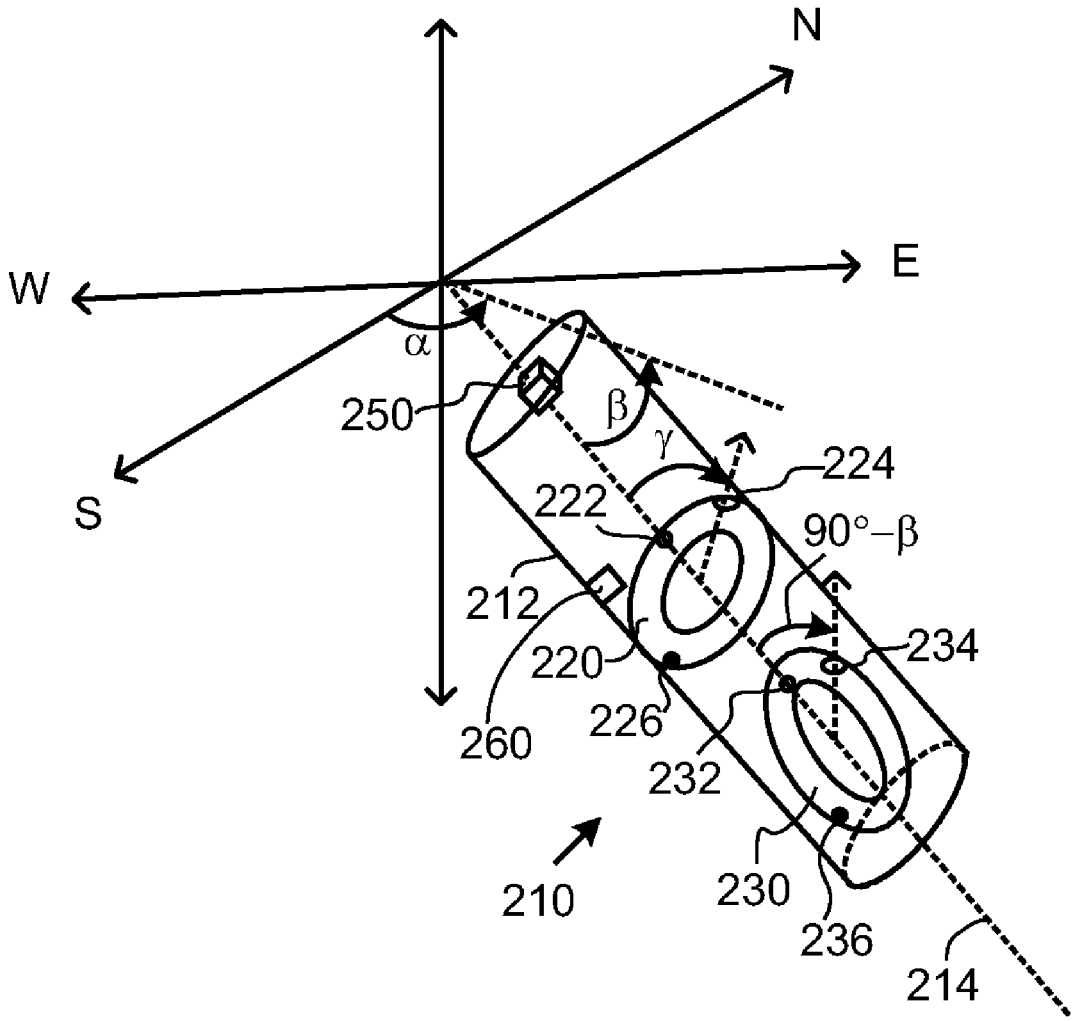
FIG. 2 shows an example of a device for determining the rotating angle of a borehole tool, according to some embodiments.

In the following detailed description of the preferred embodiments, reference is made to accompanying drawings, which form a part hereof, and within which are shown by way of illustration specific embodiments by which the invention may be practiced. It is to be understood that other embodiments may be utilized and structural changes may be made without departing from the scope of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

It is estimated that high percentage of the world's new wells have been drilled with high deviation. Therefore, according some embodiments, a robust deviated well solution is provided that is compact in size, reliable and cost effective in order to obtain directional information about tool deployment. There are an increasing number of oil field measurements and applications that require either the knowledge of the tool orientation or the precise control of the tool orientation.

In a cased borehole environments, prior recorded open hole well trajectory data can be used. Such prior open-hole data may, for example, be required by Government regulation and allows for a determination of the azimuth and inclination of the cased-hole tool once locating its position along the well. However, the rotating angle of the cased-hole tool with respect to a chosen reference is still unknown. By combining the azimuth, inclination from prior open hole data, and newly measured cased-hole tool rotational angles, the case-hole tool orientation can be completely determined referring to any Cartesian coordinate.

In a steel cased borehole magnetometer measurements cannot be reliably used to correctly to determine the direction of a borehole tool. Examples of open, uncased borehole measurements that can be used for later cased hole tool orientation purposed include the General Purposed Inclinometry Tool (GPIT) from Schlumberger.

For a deviated borehole two angular unknowns of the tool, namely the azimuth and inclination at each measured depth are essentially unchanged by the steel casing. Therefore, provided uncased measurements are available, the only unknown that remains to be measured in order to accurately determine the tool orientation at each measured depth is the tool rotating angle with respect to a fixed reference. By combining and making use of prior open hole measurements, the difficult cased borehole tool orientation measurement problem has been greatly simplified. Note that as used herein, the term "measured depth" refers to the length of the path of the wellbore. In the case of a vertical well, the measured depth will be the same as true vertical depth. However, in a deviated wellbore, the measured depth will be longer than the true vertical depth.

Advantageously, according to some embodiments, a robust low cost rotation angle measurement sensor is provided which can survive borehole shocks, vibrations and extreme temperature.

FIGS. 1*a*-1*c* show a wireline-based tool orientation measurement system, according to some embodiments. Shown in FIG. 1*a* is wireline truck 110 deploying wireline cable 112 into well 130 via well head 120. In FIG. 1*b* wireline tool 140 is disposed on the end of the cable 112 within well 130. In FIG. 1*b*, the portion of the well 130 where wireline tool 140 is located is an open-hole section. That is, there is now casing along the wall of well 130 in the area shown in FIG. 1*b*. Wireline tool 140 includes a sensor unit 142 that measures the deviation, tool azimuth and relative bearing as a function of the measured depth. According to some embodiments, unit 142 can be a general purpose inclinometry tool such as Schlumberger's GPIT tool. The measurements made by tool 140 are recorded in truck 110. FIG. 1*c* shows the same section of well 130 as shown in FIG. 1*b*, only at this time this section of the well is cased. Casing 132 is shown which is typically made of steel and cemented into place. In FIG. 1*c*, a wireline tool 150 is being deployed via wireline cable 154 in well 130 from a wireline truck (not shown) such as truck 110 in FIG. 1*a*. Wireline tool 150 includes a sensor unit 152 capable of measuring the relative rotation angle of tool 150 within well 130 as a function of measured depth. As will be more fully described below, unit 152 can also make inclination measurements.

FIG. 2 shows an example of a device for determining the rotating angle of a borehole tool, according to some embodiments. As shown FIG. 2, rotation angle device 210 includes two fluid-filled bubble rings 220 and 230 housed within tool body 212. Bubble ring 220 is fixed to tool body 212 is used to display the tool rotating angle with respect to a reference marker 222. Bubble ring 230 is gimbaled to allow free rotation along the tool axis 214 to provide tool inclination angle measurement.

Also shown in FIG. 2 are the compass directions, North, South, East and West and the 'up' and 'down' directions. The angle $\alpha$ denotes the azimuthal angle and measured with respect to the compass directions. The angle $\beta$ is the tool inclination, and the angle $\gamma$ is the tool rotation angle.

In a deviated well the bubble 224 in bubble ring 220 will indicate the top side of the tool and will not rotate with the tool providing therefore a very good and consistent reference as the top of the tool. If the reference marker 222, which for example can be a red dot fixed on the bubble ring, aligns with the center of this bubble 224 that means the tool has not been rotated. Therefore, the angle between the red dot and the bubble provides angular measurement of the rotation of the tool (angle $\gamma$). The rotational angle $\gamma$ can be determined by measuring the offset reference marker 222 to bubble 224. According to other embodiments, a ball bearing 226 instead of a bubble 224 is used to indicate the bottom side of tool surface. According to yet other embodiments, both the ball bearing 226 and the bubble 224 are used.

Bubble ring 230 is gimbaled along the tool axis 214 to provide the inclination angle of the tool (angle $\beta$). Measuring the offset of reference marker 232 to bubble 234 will give and angle which is 90 degrees minus $\beta$. Other inclination measurement techniques can also be used. However it has been found that the a gimbaled ring bubble tends to be suitable for high temperature environments.

For reading the angle information from the bubble rings, according to some embodiments a digital camera 250 is used with appropriate image processing to provide an accurate angular reading as well as monitoring the potential mechanical problems of the device. The field engineer at the surface can visually monitor the downhole tool rotations if we can send pictures in real time. Pictures provide a fantastic human interface with the angle measurements. This new visual interface concept will without doubt increase confidence in the measurement. In addition the field engineer can perform a real time quality control of device 210.

According to some embodiments, several different techniques can be used to read the position of the angular marker (e.g. a ball bearing or a bubble). According to one embodiment, angular marks are printed along the circumference of the ring to read the angle directly. According to another embodiment, an array of LED lights is used and its corresponding photo sensor array to indicate angular position of lights that are affected by either the bubble or the ball bearing. Similarly, according to another embodiment, a circumferential capacitor array is used to detect the position of the ball bearing or other conductive marker substance. However, it has been found that in many applications more precise angular measurement and corresponding tool rotating velocity or acceleration can be determined through the use of imaging processing techniques. Further details of examples of such imaging processing techniques will now be provided. As mentioned previously, a camera set inside the tool will take pictures of the system while logging. Note that the camera can take some images in continuous or at certain time intervals that are defined depending on the complexity of the logging application, the need of this data for the answer products, or simply by the field engineer.

According to another embodiment, in cases where a stationary measurement is being made a transmitter and receiver pair can be rotated about the ring to locate the position of the ball bearing instead of using an array of receivers.

Figure 3A:
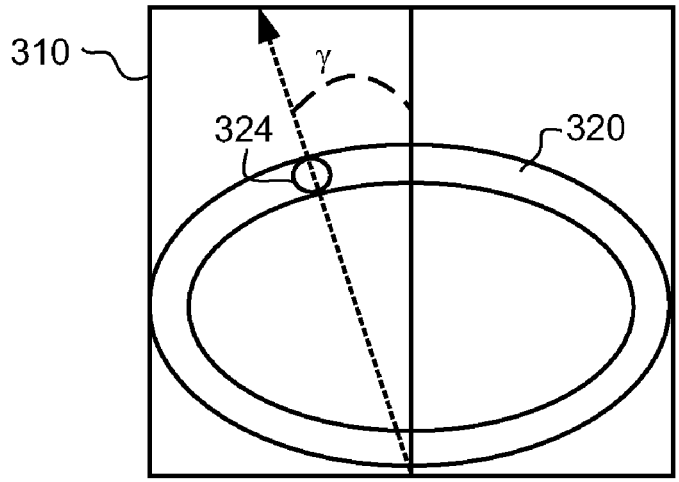
FIGS. 3*a*-*c* illustrate further details of image processing for a cased borehole tool orientation measurement system, according to some embodiments.
Figure 3B:
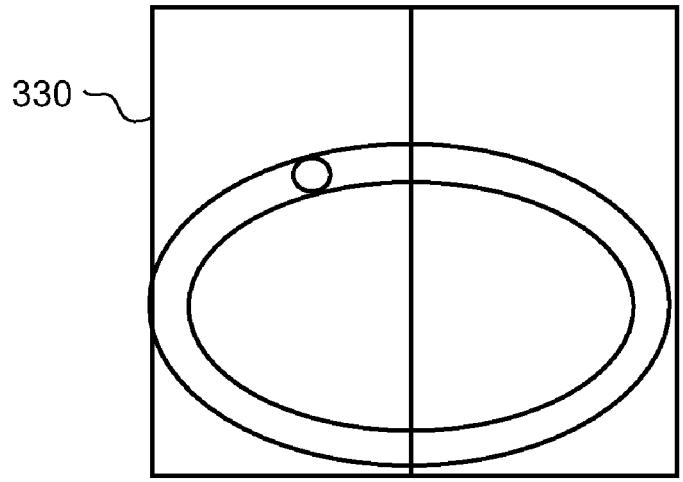
Figure 3C:
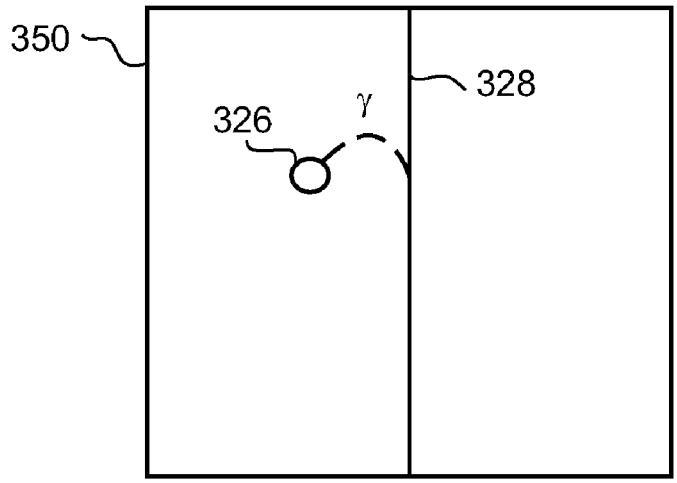

FIGS. 3*a-c* illustrate further details of image processing for a cased borehole tool orientation measurement system, according to some embodiments. FIG. 3*a* shows an example of an image 310 taken of a bubble ring 320 taken by a camera such as camera 250 shown in FIG. 2. Bubble marker 324 is shown within bubble ring 320. FIG. 3*b* shows an edge detection image 330 which results from an edge detection algorithm process run on the image 310 of FIG. 3*a*. From the edge detection image 330, main features of the image 310 are extracted. According to some embodiments, only the edge detection information from the image is stored in the tool memory board thereby minimizing the size of the data associated with the measurement process. Note that various algorithms are well known to perform edge detection of an image. For example, see: Qian, R. J. and T. S. Huang, *Optimal edge detection in two-dimensional images*, IEEE Transactions on Image Processing, volume 5 (1996), number 7, pp. 1215-1220; Henstock, P. V. and D. M. Chelberg, *Automatic gradient threshold determination for edge detection*, IEEE Transactions on Image Processing, volume 5 (1996), number 5, pp. 784-787, A Rosenfeld and M Thurston. Edge and curve detection for visual scene analysis. *IEEE Transactions on Computers,* pages 562-9, May 1971; J Canny. A computational approach to edge detection, *IEEE PAMI*, pages 679-98, November 1986; and M Tabb and N Ahuja. Multiscale image segmentation by integrated edge and region detection. *IEEE Transactions on Image Processing*, pages 642-55, May 1997.

At this stage we have extracted and stored the edge of the image in the memory of the tool. Next, an extraction step is performed. FIG. 3*c* shows an example of an extraction image 350 that results from such an extraction step. The extraction step consists of extracting from the edge image 330 the circle 326 related to the bubble 324 and estimating its angle γ compared to the reference position 328. According to some embodiments, the reference position will be represented by green circle on the image. A green LED is used to indicate the reference position, whose position can be extracted from the image along with the position of the bubble marker. The angle γ between the extracted bubble and the reference position will provide the tool orientation angle.

According to some embodiments, in order to provide an easy quality control check at the well site, only the edge information of the bubbles or other markers are sent to the surface, thereby allowing the engineer to see how the tool is rotating in the hole. Note that since the image processing steps are relatively simple, the process is extremely fast. Thus, this approach is suitable for downhole and wellsite implementations.

Figure 4:
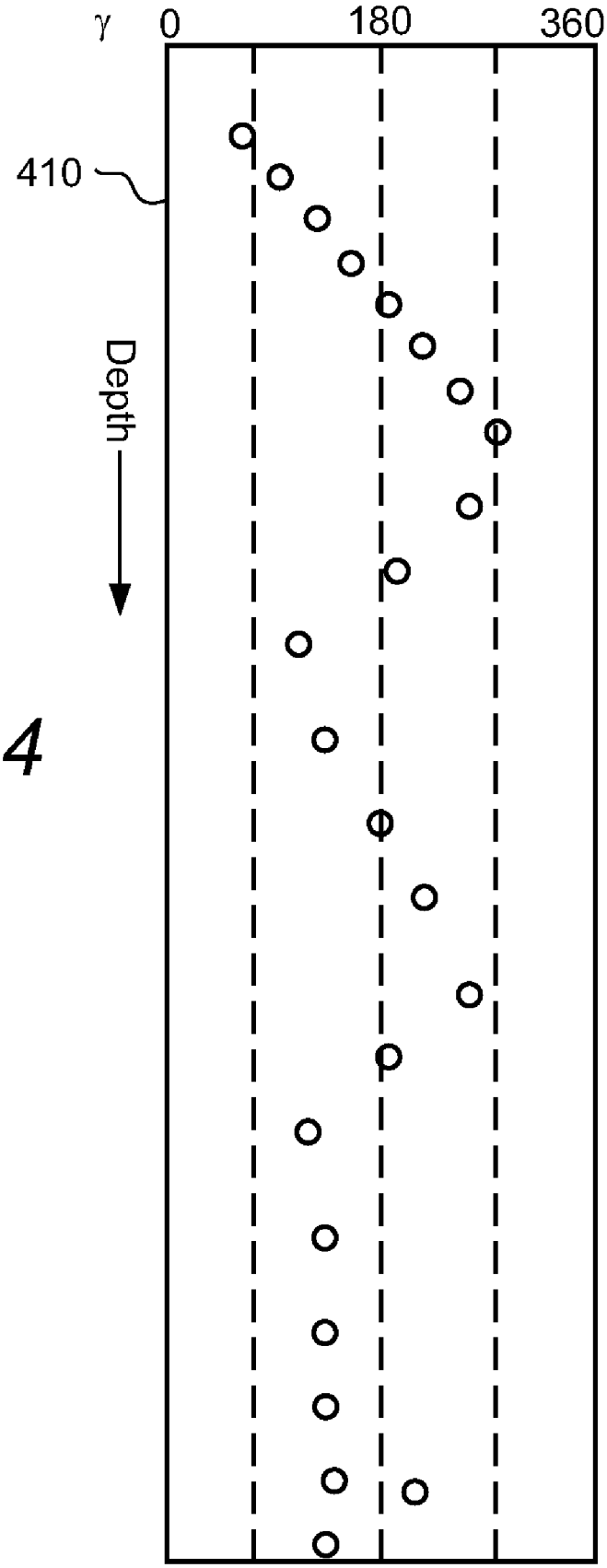
FIG. 4 shows an example of a log indicating the rotational positions of the bubble marker extracted at different measured depths, according to some embodiments.

FIG. 4 shows an example of a log indicating the rotational positions of the bubble marker extracted at different measured depths, according to some embodiments. Plot 410 shows angle γ in degrees of the bubble marker for various measured depths. The angle γ thus gives the orientation of the tool in the casing at each measured depth. From this simple log, the angle of interest γ is extracted. The correlated angle γ and measured depth information can be stored as a Las file, according to some embodiments.

Figure 5:
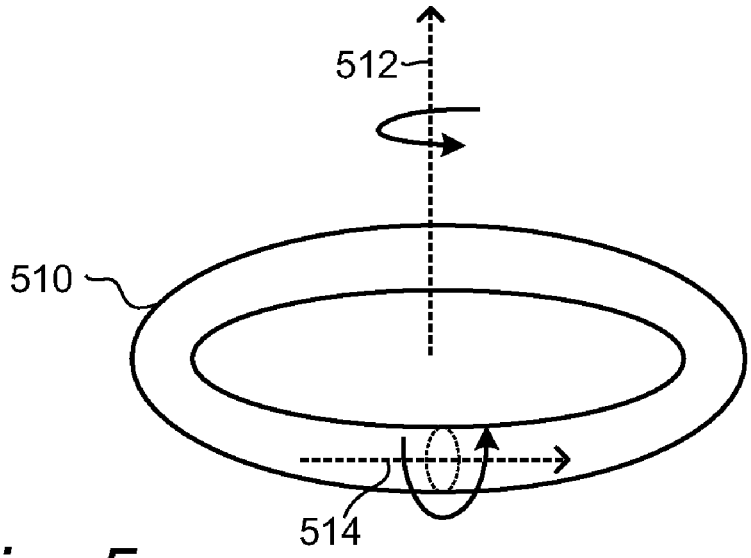
FIG. 5 shows an example of a fluid channel having two rotational symmetries, according to some embodiments.

FIG. 5 shows an example of a fluid channel having two rotational symmetries, according to some embodiments. After testing several different mechanical design options it has been found that a fluid channel with two rotational symmetries provides the ability to measure the tool rotation in any borehole direction, in most applications. Fluid channel 510 is rotationally symmetric about a central axis 512, and the cross section of channel 510 is rotationally symmetric about an axis 514.

Figure 6:
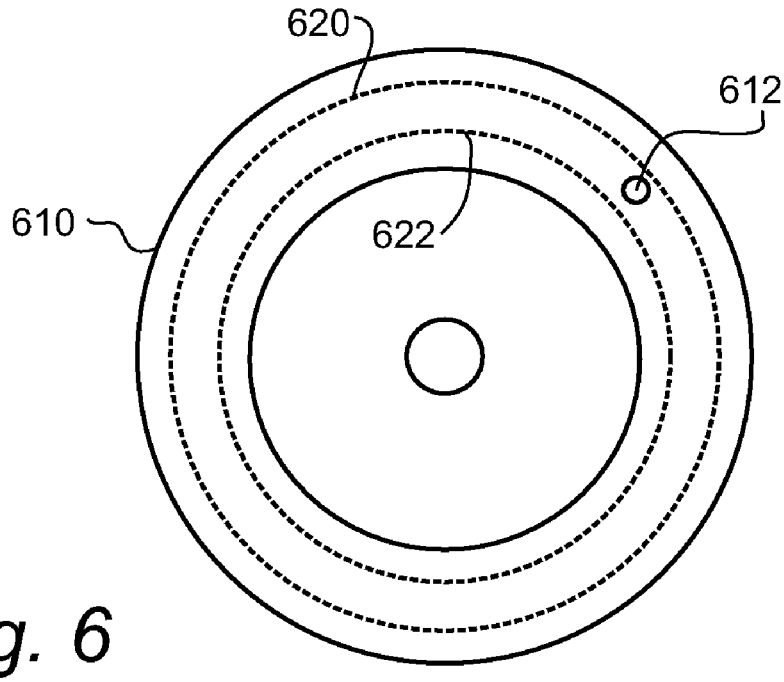
FIG. 6 is a cross sectional view of a bubble ring, according to some embodiments.

In a dynamic system a spherical solid marker such as a ball bearing has been found to respond faster than a gas bubble marker in many applications. For many applications, it is preferable to introduce fluid viscosity to damp the pendulum motion of the ball bearing marker with respect to its stationary point. Gas bubble markers tend to be subject to larger thermal expansion with borehole extreme temperature than solid markers such as a ball bearing. FIG. 6 is a cross sectional view of a bubble ring, according to some embodiments. The bubble ring 610 is preferably constructed using two optically transparent plastic or glass halves combined to form a fluid channel including a small ball bearing marker 612 in between. The dashed lines 620 and 622 indicate the boundaries of this fluid channel.

Figure 7:
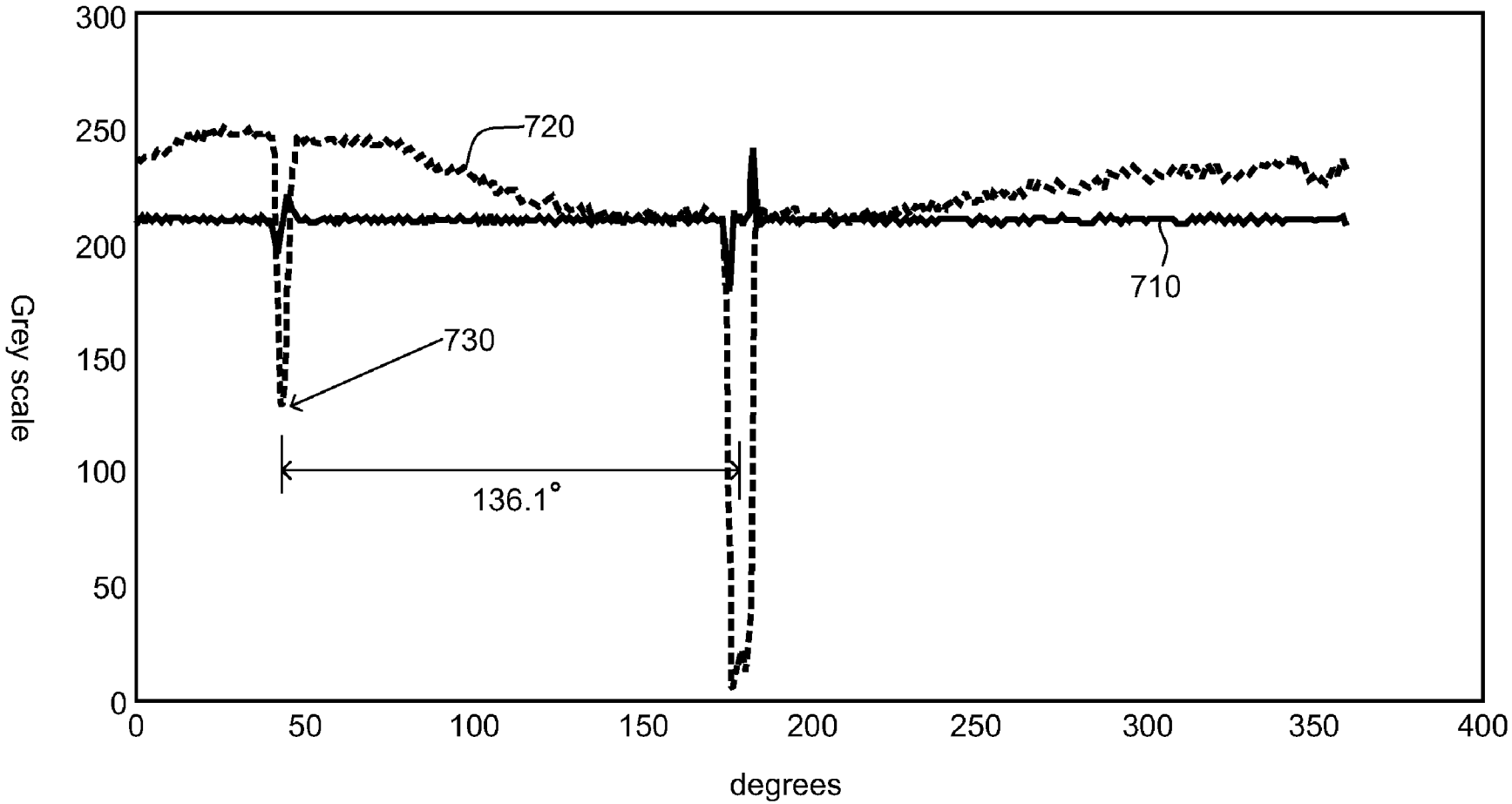
FIG. 7 is a graph showing the accuracy of rotation angle measurement, according to some embodiments.

FIG. 7 is a graph showing the accuracy of rotation angle measurement, according to some embodiments. Curve 720 is the spatially interpolated grey scale level data for the image along the circle. The origin is shown at location 730. The edge detection curve 710 is curve 720 differentiated to locate the edges of both the origin reference 730 and the marker, which in this case was a steel ball. The rotation angle is determined to be 136.1°. Note that in this example the rotation angle can be determined to within 0.1°.

Figure 8:
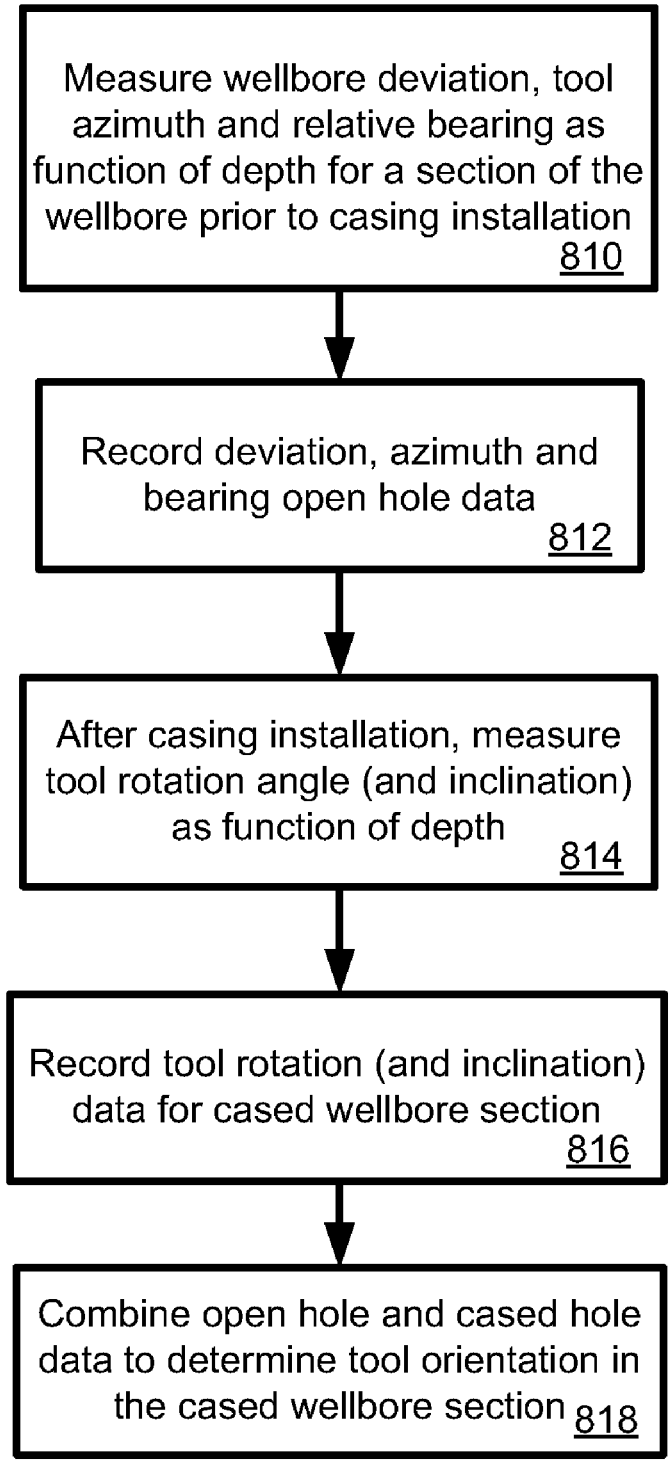
FIG. 8 is a flowchart showing steps involved in determining tool orientation for cased sections of boreholes, according to some embodiments.

FIG. 8 is a flowchart showing steps involved in determining tool orientation for cased sections of boreholes, according to some embodiments. In step 810 measurements are taken of the section of interest of the well prior to installation of the wellbore casing. For example, this could be trajectory data gathered during the drilling process or during prior open hole wireline survey. According to some embodements, the measurements are taken using an inclinometry tool such as Schlumberger's GPIT tool. IN step 812, the open hole measurements are recorded on the surface. In step 814, after the section of interest of the wellbore has been cased, the tool rotation angle is measured at different measured depths using the techniques described herein. According to some embodiments, tool inclination angle is also measured as described herein. In step 816, the cased hole measurements are recorded at the surface. In step 818, the open-hole data and the cased hole data is combined by correlating measured depth measurements and the tool orientation for the cased hole tool can be determined.

Although many of the embodiments have been described with respect to wireline tools used for both the open hole and cased hole measurements, the techniques described herein are also applicable to logging while drilling (LWD) and measurement while drilling (MWD) environments. In particular the central opening of the bubble ring embodiments such as shown and described with respect to FIGS. 2, 3, 5 and 6 lend themselves to positioning on a drillstring so as to allow an adequate central flowpath for the drilling mud.

It has been found that a small amount of vibration is useful in increasing accuracy when the inclination angle is small (i.e. close to vertical). According to some embodiments, in applications where there is very little external vibration, an active vibrator can be used to vibrate the sensor. For example, in FIG. 2, vibrator 260 could be included to impart vibrations on bubble ring 220 when tool is very close to vertical.

According to further embodiments, the high accuracy of angular measurement and high-repeatability of the rotation angle sensor can be used for other applications where tool rotation sensing is needed. For example, the bubble ring sensors described herein can be used with a casing perforation tool. In the context of FIG. 1*c*, the tool 150 could be multi-shot perforation tool.

Whereas many alterations and modifications of the present invention will no doubt become apparent to a person of ordinary skill in the art after having read the foregoing description, it is to be understood that the particular embodiments shown and described by way of illustration are in no way intended to be considered limiting. Further, the invention has been described with reference to particular preferred embodiments, but variations within the spirit and scope of the invention will occur to those skilled in the art. It is noted that the foregoing examples have been provided merely for the purpose of explanation and are in no way to be construed as limiting of the present invention. While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A system for determining orientation of a measurement tool in a cased borehole comprising:

a tool housing forming part of the measurement tool and being designed to be deployed in a cased section of a borehole;

a volume within the tool housing and containing a reference fluid having a first density;

a marker having a second density, the marker being disposed within the volume containing reference fluid such that the marker is moveable within the volume, the second density being substantially different from the first density;

a sensing system adapted and positioned to sense the position of the marker within volume containing the reference fluid; and a processing system adapted and programmed to determine orientation information of the measurement tool based at least in part on combining information relating to the position of the marker with prior recorded data representing orientation measurements made while the section of the borehole was not yet cased.

2. A system according to claim 1 wherein the marker is a second fluid.

3. A system according to claim 2 wherein the second fluid is a bubble of gas, and the reference fluid is a liquid.

4. A system according to claim 1 wherein the marker is a solid object.

5. A system according to claim 4 wherein the marker is spherical in shape.

6. A system according to claim 1 further comprising a vibrator adapted and positioned to impart vibrations on the volume so as to increase accuracy of measurement.

7. A system according to claim 1 wherein the position of the marker within the volume can be used to determine the rotational position of the measurement tool within the cased section of the borehole.

8. A system according to claim 7 further comprising an origin marker fixedly positioned relative to the volume, and wherein the rotational position is determined at least in part by determining the position of the marker with respect to the origin marker.

9. A system according to claim 1 further comprising a depth measurement system for measuring the current measured depth of the measurement tool.

10. A system according to claim 9 wherein the processing system combines the information relating to the position of the marker and the prior recorded data by correlating data having equivalent measured depths.

11. A system according to claim 1 wherein the prior recorded data includes one or more property as a function of measured depth selected from the group consisting of:

wellbore deviation, tool azimuth, and relative bearing.

12. A system according to claim 1 wherein the volume has two or more rotational symmetries.

13. A system according to claim 12 wherein the volume is ring shaped and is constructed of walls at least some of which are transparent or translucent.

14. A system according to claim 13 wherein the sensing system includes a camera positioned and adapted to capture images of the position of the marker.

15. A system according to claim 13 further comprising an image processing system adapted and programmed to extract information from the captured images based at least in part on edge detection.

16. A system according to claim 1 wherein information relating to the position of the marker is transmitted to the surface such that an engineer on the surface can assess information regarding the measurement tool.

17. A system according to claim 1 further comprising a second volume containing a second reference fluid the volume being shaped, positioned and mounted to the tool housing so as to allow for measurements of the inclination angle of the measurement tool within the cased borehole.

18. A system according to claim 1 wherein the measurement tool is a conveyed on a wireline.

19. A system according to claim 1 wherein the measurement tool is conveyed on a drillstring.

20. A method for determining orientation of a measurement tool in a cased borehole comprising:

deploying the measurement tool in a cased section of a borehole, the measurement tool including a volume containing a reference fluid having a first density, and a marker having a second density, the marker being disposed within the volume containing reference fluid such that the marker is moveable within the volume, the second density being substantially different from the first density;

sensing the position of the marker within volume containing the reference fluid; and determining orientation information of the measurement tool based at least in part on combining information relating to the position of the marker with prior recorded data representing orientation measurements made while the section of the borehole was not yet cased.

21. A method according to claim 20 wherein the marker is a second fluid.

22. A method according to claim 21 wherein the second fluid is a bubble of gas, and the reference fluid is a liquid.

23. A method according to claim 20 wherein the marker is a solid object.

24. A method according to claim 23 wherein the marker is spherical in shape.

25. A method according to claim 20 further comprising determining the rotational position of the measurement tool within the cased section of the borehole based at least in part on the sensed position of the marker within the volume.

26. A method according to claim 20 further comprising measuring the measured depth of the measurement tool, and wherein the position of the marker and the prior recorded data are combined by correlating data having equivalent measured depths.

27. A method according to claim 20 wherein the prior recorded data includes one or more property as a function of measured depth selected from the group consisting of: wellbore deviation, tool azimuth, and relative bearing.

28. A method according to claim 20 wherein the volume is ring shaped and is constructed of walls at least some of which are transparent or translucent.

29. A method according to claim 28 wherein the position of the marker within the volume is sensed using a camera positioned and adapted to capture images of the position of the marker.

30. A method according to claim 29 further comprising extracting information from the captured images based at least in part on one or more edge detection algorithms.

31. A method according to claim 20 further comprising transmitting information relating to the position of the marker to the surface such that an engineer on the surface can assess information regarding the measurement tool.

32. A method according to claim 20 wherein the measurement tool further includes a second volume containing a second reference fluid the volume being shaped, and positioned and mounted to the tool housing so as to allow for measurements of the inclination angle of the measurement tool within the cased borehole.

* * * * *